US012529280B2

(12) United States Patent
Sommerfeld et al.

(10) Patent No.: US 12,529,280 B2
(45) Date of Patent: Jan. 20, 2026

(54) SYSTEMS AND METHODS FOR CEMENTING CASING AND SEALING A HANGER IN A WELLHEAD HOUSING

(71) Applicant: Cameron International Corporation, Houston, TX (US)

(72) Inventors: Kyle Sommerfeld, Houston, TX (US); Andrew Sanders, Houston, TX (US); Leonard Vogel, Houston, TX (US); Dennis Nguyen, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 18/748,193

(22) Filed: Jun. 20, 2024

(65) Prior Publication Data

US 2024/0426186 A1 Dec. 26, 2024

Related U.S. Application Data

(60) Provisional application No. 63/509,076, filed on Jun. 20, 2023.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | | |
|---|---|---|---|---|
| 4,848,457 | A | 7/1989 | Lilley | |
| 9,611,717 | B2 | 4/2017 | Lockwood | |
| 2007/0169940 | A1* | 7/2007 | Fenton | E21B 33/043 166/368 |
| 2008/0017368 | A1* | 1/2008 | Hopper | E21B 33/03 166/75.14 |
| 2014/0251634 | A1* | 9/2014 | Curtiss | E21B 33/0422 166/368 |
| 2016/0326838 | A1* | 11/2016 | Porter | E21B 17/02 |
| 2020/0284118 | A1* | 9/2020 | Xiao | E21B 33/0407 |
| 2021/0238937 | A1* | 8/2021 | McLaughlin | E21B 43/013 |

FOREIGN PATENT DOCUMENTS

| | | | |
|---|---|---|---|
| WO | 2024138145 | A1 | 6/2024 |
| WO | 2024138148 | A1 | 6/2024 |

* cited by examiner

*Primary Examiner* — Taras P Bemko
(74) *Attorney, Agent, or Firm* — Jeffrey D. Frantz

(57) ABSTRACT

A wellhead includes a wellhead housing, a hanger configured to support a casing, and multiple passages formed in or along the wellhead housing, through the hanger, external to the wellhead housing, or any combination thereof. The wellhead also includes at least one movable component configured to move relative to the multiple passages to selectively enable a flow of fluid via the multiple passages from an annular space defined between the wellhead housing and the hanger below the hanger to a portion of a bore within the wellhead housing above the hanger.

20 Claims, 6 Drawing Sheets

SYSTEMS AND METHODS FOR CEMENTING CASING AND SEALING A HANGER IN A WELLHEAD HOUSING

CROSS-REFERENCE TO RELATED APPLICATION

This application claims priority to and the benefit of U.S. Provisional Application No. 63/509,076, entitled "SYSTEMS AND METHODS FOR CEMENTING CASING AND SEALING A HANGER IN A WELLHEAD HOUSING" and filed Jun. 20, 2023, the disclosure of which is incorporated herein by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below a surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a wellhead includes a wellhead housing, a hanger configured to support a casing, and multiple passages formed in or along the wellhead housing, through the hanger, external to the wellhead housing, or any combination thereof. The wellhead also includes at least one movable component configured to move relative to the multiple passages to selectively enable a flow of fluid via the multiple passages from an annular space defined between the wellhead housing and the hanger below the hanger to a portion of a bore within the wellhead housing above the hanger.

In certain embodiments, a wellhead includes a wellhead housing, a hanger configured to support a casing, a first passage formed in or along the wellhead housing, and a second passage formed through the hanger. The wellhead also includes at least one annular seal assembly configured to move relative to the first passage and the second passage to selectively enable and block a flow of fluid axially across the hanger via the first passage and the second passage.

In certain embodiments, a method of operating a wellhead includes running a hanger and one or more seal assemblies into a wellhead housing. The method also includes positioning the one or more seal assemblies to enable a flow of fluid axially across the hanger via one or more housing passages formed in or along the wellhead housing and via one or more hanger passages formed through the hanger. The method further includes repositioning the one or more seal assemblies to block the flow of fluid axially across the hanger via the one or more housing passages formed in or along the wellhead housing and via the one or more hanger passages formed through the hanger.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
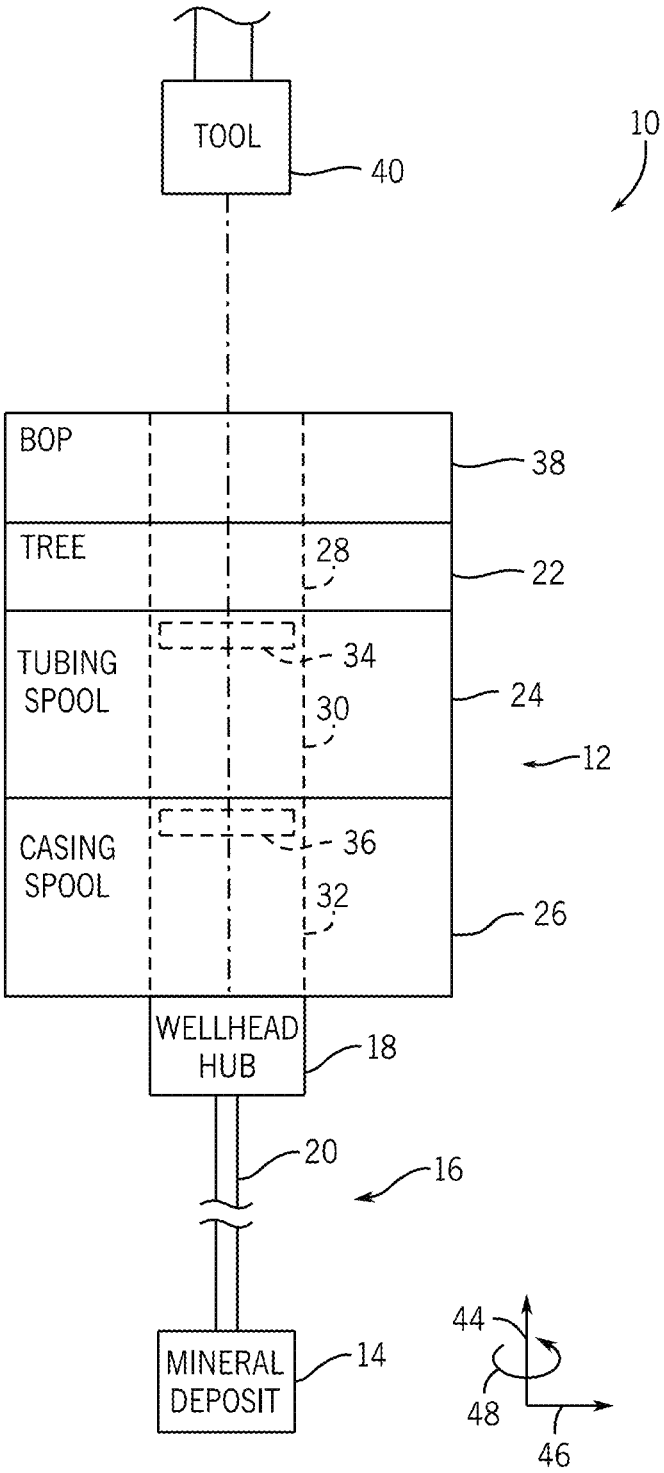
FIG. 1 is a block diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure generally relate to systems and methods that support efficient casing installation operations. For example, certain embodiments of the present disclosure include one or more passages formed in or along a wellhead housing, through a hanger, external to the wellhead housing, or any combination thereof. The one or more passages are selectively sealed via one or more movable seal components, such as one or more plugs, pistons, valves, plungers, inflatable bladders, or any combination thereof, for example. In some embodiments, the one or more movable seal components may include a seal assembly (e.g., annular seal assembly; ring) that seals an annular space between the wellhead housing and the hanger. During cementing operations, the one or more movable components may be positioned to enable a flow of fluid through the one or more passages. Then, after the cementing operations, the one or more movable components may be positioned to block the flow of fluid through the one or more passages (e.g., to seal the one or more passages). For example, the one or more movable components may be positioned (e.g., repositioned; moved) via rotating the one or more movable components and/or moving the one or more movable components in an axial direction and/or a radial direction relative to the wellhead housing, the hanger, and/or one or more external passages.

Advantageously, the systems and methods disclosed herein may avoid separately running a separate seal assembly into the wellhead housing after the cementing operations. For example, no additional seal packoff elements or steps may be run into the wellhead housing to seal the hanger to the wellhead housing after the cementing operations. Instead, for example, the systems and methods disclosed herein enable a seal assembly to run with the hanger into the wellhead housing. Accordingly, the systems and methods disclosed herein may save time and associated costs during drilling operations.

Further, the systems and methods disclosed herein may provide advantages with respect to flow of cement returns. For example, certain passages may provide a cross-sectional area that permits flow of large particles in the cement returns, multiple passages may provide a total cross-sectional area that enables a large volumetric flow rate of the cement returns, and so forth. Accordingly, multiple passages may provide variation in respective cross-sectional area to enable different particle sizes to travel through the multiple passages and/or the multiple passages may provide additional flow-by area (e.g., compared to only a single passage), which in turn may result in faster cementing operations and/or improve cementing operations via low occurrence of blockages due to large particles, for example.

Additionally, the systems and methods disclosed herein may be designed to provide such advantages in an efficient manner, such as with respect to component number and/or space. For example, one or more housing passages in the wellhead housing may be provided in combination with one or more hanger passages in the hanger such that the one or more housing passages and the one or more hanger passages may be selectively sealed via one seal assembly (e.g., one annular seal assembly). As another example, the one or more housing passages may be selectively sealed by a movable seal component integrated into or carried with the hanger, while the one or more hanger passages may be selectively sealed via one seal assembly (e.g., with the movable seal component and the one seal assembly moving at one time; simultaneously). As yet another example, the one or more housing passages, the one or more hanger passages, and/or the one or more external passages may be aligned with one another along an axial axis (e.g., fully or at least partially overlap along the axial axis) during flow of the cement returns across the hanger, which may provide efficiency with respect to space (e.g., compact structure along the axial axis). Further, the one or more housing passages, the one or more hanger passages, and/or the one or more external passages may be arranged in various manners about a circumferential axis to provide efficiency, balance, and/or maintain structural features (e.g., strength). For example, the one or more housing passages and the one or more external passages may be offset relative to one another about the circumferential axis to offset openings and/or grooves about the wellhead housing.

With the foregoing in mind, FIG. 1 is a block diagram of an embodiment of a mineral extraction system 10. The mineral extraction system 10 may be utilized to access and/or extract various natural resources (e.g., hydrocarbons, such as oil and/or natural gas) from the earth. As illustrated, the mineral extraction system 10 includes a wellhead 12 (e.g., annular wellhead) coupled to a mineral deposit 14 via a well 16. The well 16 may include a wellhead hub 18 (e.g., annular wellhead hub) and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi).

Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools (e.g., a tool 40) into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. The tool 40 may be utilized to lower the tubing hanger 34 into the tubing spool 24 and/or the casing hanger 36 into the casing spool 26.

As discussed in more detail herein, one or more passages may be formed in or along a wellhead housing (e.g., the spool 24, 26) and/or through a hanger (e.g., the hanger 34, 36) and/or external to the wellhead housing. The one or more passages are selectively sealed via one or more movable components (e.g., a piston, a valve, a plunger, an inflatable bladder, a seal assembly that may be integral to or separate from the hanger 34, 36, or any combination thereof). During cementing operations, the one or more movable components may be positioned to enable a flow of fluid through the one or more passages. Thus, the flow of fluid may pass from below the hanger to above the hanger (e.g., relative to the wellbore) via the one or more passages. Then, after the cementing operations, the one or more movable components may be positioned to block the flow of fluid through the one or more passages (e.g., to seal the one or more passages). Thus, the flow of fluid may not pass from below the hanger to above the hanger via the one or more passages. To facilitate discussion, the mineral extraction system 10, and the components therein, may be described with reference to an axial axis or direction 44, a radial axis or direction 46, and a circumferential axis or direction 48.

Figures 2, 3, 4, 5:
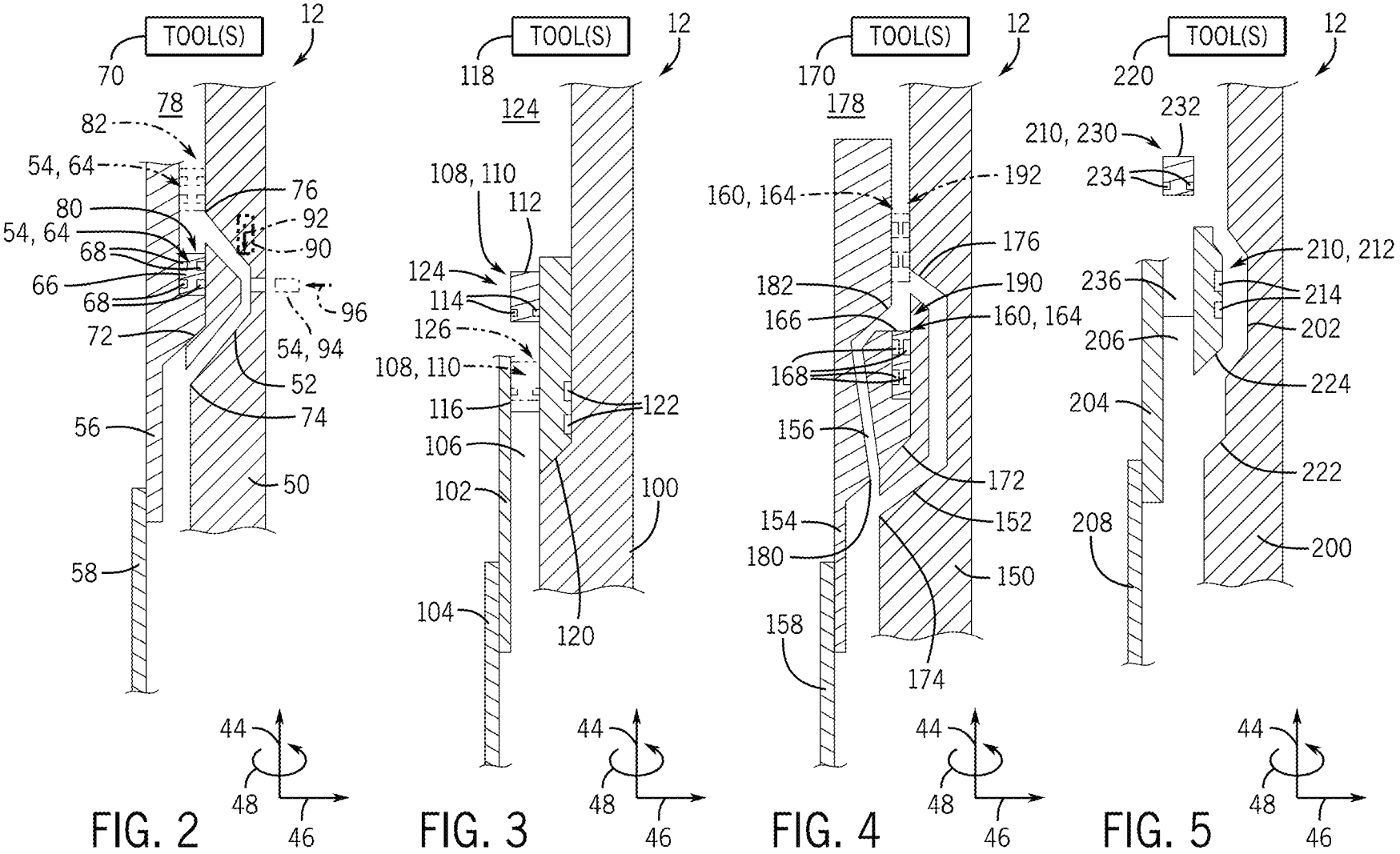
FIG. 2 is a cross-sectional side view of an embodiment of a portion of a wellhead that may be utilized in the mineral extraction system of FIG. 1, wherein a wellhead housing includes one or more housing passages and a movable seal component is configured to move relative to the one or more housing passages to selectively seal the one or more housing passages.
FIG. 3 is a cross-sectional side view of an embodiment of a portion of a wellhead that may be utilized in the mineral extraction system of FIG. 1, wherein a hanger includes one or more hanger passages and a movable seal component is configured to move relative to the one or more hanger passages to selectively seal the one or more hanger passages.
FIG. 4 is a cross-sectional side view of an embodiment of a portion of a wellhead that may be utilized in the mineral extraction system of FIG. 1, wherein a wellhead housing includes one or more housing passages and a hanger includes one or more hanger passages.
FIG. 5 is a cross-sectional side view of an embodiment of a portion of a wellhead that may be utilized in the mineral extraction system of FIG. 1, wherein a wellhead housing includes one or more housing passages formed as one or more grooves and a hanger includes one or more hanger passages.

FIG. 2 is a cross-sectional side view of an embodiment of at least some features that may be provided as part of the wellhead 12. As shown, a wellhead housing 50 (e.g., a portion of a casing spool, such as a portion of the casing spool 36 of FIG. 1) includes one or more housing passages 52 and a movable seal component 54 configured to move relative to the one or more housing passages 52 to selectively seal the one or more housing passages 52. The one or more housing passages 52 may include a single housing passage or multiple housing passages distributed (e.g., spaced apart) about the circumferential axis 48. A hanger 56 (e.g., a casing hanger, such as the casing hanger 36 of FIG. 1) is positioned in the wellhead housing 50 and suspends a casing 58 that extends into a wellbore. For example, the casing 58 may pass through an additional casing and/or a conductor to extend into the wellbore.

In FIG. 2, the movable seal component 54 is a seal assembly 64 (e.g., annular seal assembly) and is positioned about the hanger 56. As shown, the seal assembly 64 may include a seal body 66 (e.g., annular seal body) that supports one or more seal elements 68 (e.g., annular seal elements). In operation, a running tool(s) 70 coupled to the hanger 56 and/or the seal assembly 64 may lower the hanger 56 with the casing 58, as well as the seal assembly 64, into the wellhead housing 50. The running tool(s) 70 may lower the hanger 56 until the hanger 56 reaches a landed position in which the hanger 56 is landed on the wellhead housing 50 (e.g., axially facing or radially overlapping surfaces contact one another at an interface 72 to block further movement of the hanger 56 relative to the wellhead housing 50 toward the wellbore). In the landed position, the seal assembly 64 may be at a first axial location of the wellhead housing 50. In certain embodiments, in the landed position, the seal assembly 64 may contact and seal against the wellhead housing 50 at the first axial location of the wellhead housing 50, which may protect (e.g., cover) the one or more seal elements 68 (e.g., during cementing operations). However, the one or more housing passages 52 provide a bypass pathway for fluid flow (e.g., cement returns) between a second axial location within the wellhead housing 50 (e.g., below the first axial location relative to the wellbore) to a third axial location within the wellhead housing 50 (e.g., above the first axial location relative to the wellbore). For example, each of the one or more housing passages 52 includes a first opening 74 (e.g., inlet) exposed to the annular space at the second axial location and a second opening 76 (e.g., outlet) exposed to the annular space (or, more generally, a bore 78 of the wellhead housing 50) at the third axial location.

As described herein, the seal assembly 64 is configured to move relative to the one or more housing passages 52 (e.g., along the axial axis 44) to selectively seal the one or more housing passages 52. Thus, once the hanger 56 is in the landed position with the seal assembly 64 at the first axial location within the wellhead housing 50 (e.g., between the first opening(s) 74 and the second opening(s) 76 along the axial axis 44; aligned with the one or more housing passages 52 along the axial axis 44), cementing operations may commence to cement the casing 58 within the wellbore. The seal assembly 64 is positioned to enable the fluid flow from the first opening(s) 74 to the second opening(s) 76 via the one or more housing passages 52. In particular, the fluid flow may travel into the first opening(s) 74, through the one or more housing passages 52, and out the second opening(s) 76 to return to the annular space (or the bore 78).

Once the cementing operations are complete, the seal assembly 64 is driven/moved (e.g., along the axial axis 44; relative to the one or more housing passages 52; relative to the wellhead housing 50; via the tool(s) 70) to block the fluid flow through the one or more housing passages 52. For example, the seal assembly 64 may be driven/moved from a first position 80 shown in solid lines in FIG. 2 during the cementing operations to enable the fluid flow through the one or more housing passages 52, to a second position 82 shown in dashed lines in FIG. 2 after the cementing operations to block the fluid flow. As shown, with the seal assembly 64 in the second position 82, the one or more seal elements 68 seal against the wellhead housing 50 and the hanger 56 at the second axial location of the wellhead housing 50 to block the fluid flow.

It should be appreciated that the one or more housing passages 52 shown in FIG. 2 are merely exemplary, and that the one or more housing passages 52 may have any of a variety of configurations. Accordingly, it should also be appreciated that the movable seal component 54 may also have any of a variety of configurations to selectively seal the one or more housing passages 52. For example, the one or more housing passages 52 may include one or more additional openings, which may facilitate cementing operations for additional stages or levels of hangers and casings.

As another example, the seal assembly 64 may be integrated into the hanger 56 (e.g., a body of the hanger 56; a single, solid body). In such cases, the hanger 56 with the seal assembly 64 therein may be driven/moved (e.g., along the axial axis 44; relative to the one or more housing passages 52; relative to the wellhead housing 50; via the tool(s)) 70) to block the fluid flow.

As yet another example, the movable seal component 54 may additionally or alternatively include one or more plugs, pistons, valves, plungers, inflatable bladders, or any combination thereof. For example, the movable seal component 54 may include one or more seal components 90 (e.g., one or more plugs, pistons, valves, plungers, or inflatable bladders) that is driven/moved (e.g., via mechanical force, such as fluid pressure; via electronic control signals) along the axial axis 44 as shown by arrow 92 to extend into the one or more housing passages 52 to block the fluid flow. As another example, one or more seal components 94 (e.g., one or more plugs, pistons, valves, plungers, or inflatable bladders) may be driven/moved (e.g., manually by an operator; via mechanical force, such as fluid pressure; via electronic control signals) along the radial axis 46 as shown by arrow 96 to extend into the one or more housing passages 52 to block the fluid flow. With reference to FIG. 2, the seal component 90 and the seal component 94 are shown in dashed lines. It should be appreciated that, in certain embodiments, a lock (e.g., lock ring) may be utilized (e.g., engage the wellhead housing 50 and the hanger 56) to support or hold the hanger 56.

FIG. 3 is a cross-sectional side view of an embodiment of at least some features that may be provided as part of the wellhead 12. In FIG. 3, the portion of the wellhead 12 includes a wellhead housing 100 (e.g., a portion of a casing spool, such as a portion of the casing spool 26 of FIG. 1) and a hanger 102 (e.g., a casing hanger, such as the casing hanger 36 of FIG. 1). The hanger 102 is positioned in the wellhead housing 100 and suspends a casing 104 that extends into a wellbore. For example, the casing 104 may pass through one or more additional casings and/or a conductor to extend into the wellbore.

The hanger 102 includes one or more hanger passages 106. The one or more hanger passages 106 may include a single hanger passage or multiple hanger passages 106 distributed (e.g., spaced apart) about the circumferential axis 48 of the hanger 102. A movable seal component 108 is configured to move relative to the one or more hanger passages 106 to selectively seal the one or more hanger passages 106.

In FIG. 3, the movable seal component 108 is a seal assembly 110 (e.g., annular seal assembly). As shown, the seal assembly 110 may include a seal body 112 (e.g., annular seal body) that supports one or more seal elements 114 (e.g., annular seal elements) and that is configured to move relative to the hanger 102, such as to fit within a pocket portion 116 (e.g., annular pocket or recess) of the hanger 106, to selectively seal the one or more hanger passages 106.

In operation, a running tool(s) 118 coupled to the hanger 102 and/or the seal assembly 110 may lower the hanger 102 with the casing 104, as well as the seal assembly 110, into the wellhead housing 100. The running tool(s) 118 may lower the hanger 102 until the hanger 102 reaches a landed position in which the hanger 102 is landed on the wellhead housing 100 (e.g., axially facing or radially overlapping surfaces contact one another at an interface 120 to block further movement of the hanger 102 relative to the wellhead housing 100 toward the wellbore). As shown, one or more hanger seal elements 122 (e.g., annular seal elements) may provide one or more seals (e.g., annular seals) between the hanger 102 and the wellhead housing 100.

As shown, in the landed position of FIG. 3, the seal assembly 110 may be outside of the pocket portion 116 (e.g., axially offset from the pocket portion 116; above the pocket portion 116 relative to the wellbore) and does not block or cover the one or more hanger passages 106. Thus, the one or more hanger passages 106 provide a bypass pathway for fluid flow (e.g., cement returns) axially across the hanger 102. For example, each of the one or more hanger passages 106 includes a first opening (e.g., inlet) exposed to an annular space below the hanger 102 relative to the wellbore and a second opening (e.g., outlet) exposed to the annular space (or, more generally, a bore 124 of the wellhead housing 100) above the hanger 102 relative to the wellbore.

In particular, prior to running the hanger 102 with the casing 104 and the seal assembly 110 into the wellhead housing 100, the seal assembly 110 may be coupled to the hanger 102. Thus, the seal assembly 110 may be coupled to the hanger 102 such that the seal assembly 110 is in a first position (e.g., unsealed position) relative to the hanger 102 as the running tool(s) 118 runs the hanger 102 with the casing 104 and the seal assembly 110 into the wellhead housing 100. Thus, once the hanger 102 is in the landed position, cementing operations may commence to cement the casing within the wellbore. In this way, the one or more hanger passages 106 provide the bypass pathway for fluid flow (e.g., cement returns) axially across the hanger 102.

As described herein, the seal assembly 110 is configured to move relative to the one or more hanger passages 106 (e.g., along the axial axis 44) to selectively seal the one or more hanger passages 106. Thus, from the landed position and after cementing operations, the seal assembly 110 may be driven/moved (e.g., along the axial axis 44, such as via rotation; via the running tool(s) 118; relative to the hanger 102; relative to the one or more hanger passages 106) to block the fluid flow. For example, the seal assembly 110 may be driven/moved from a first position 124 shown in solid lines in FIG. 3 during the cementing operations to enable the fluid flow through the one or more hanger passages 106, to a second position 126 shown in dashed lines in FIG. 3 after the cementing operations to block the fluid flow. As shown, with the seal assembly 110 in the second position 126, the one or more seal elements 114 seal against the hanger 102 to block the fluid flow.

It should be appreciated that the one or more hanger passages 106 shown in FIG. 3 are merely exemplary, and that the one or more hanger passages 106 may have any of a variety of configurations. Accordingly, it should also be appreciated that the movable seal component 108 may also have any of a variety of configurations to selectively seal the one or more hanger passages 106. For example, the movable seal component 108 may additionally or alternatively include one or more plugs, pistons, valves, plungers, inflatable bladders, or any combination thereof. As another example, the movable seal component 108 may include multiple plungers that are driven/moved to extend into multiple hanger passages 106 (e.g., one plunger per hanger passage) to block the fluid flow. Similarly, one or more inflatable bladders may be driven/moved relative to and/or into the one or more hanger passages 106 to block the fluid flow. In certain embodiments, a lock (e.g., lock ring) may be utilized (e.g., engage the wellhead housing 100 and the hanger 102) to support or hold the hanger 102 within the wellhead housing 100.

As described herein, one or more housing passages in or along the wellhead housing, one or more hanger passages formed through a hanger, and/or one more passages external to the wellhead housing may be combined together (e.g., present and utilized to enable and block fluid flow, such as cement returns). In such cases, one or more movable components may be utilized to selectively open and close the multiple passages. For example, the seal assembly may be modified (e.g., sized, positioned, additional seal elements) to selectively open and close the multiple passages together. As another example, the seal assembly may be utilized in conjunction with another movable component (e.g., a plug, a valve). This may also provide various advantages, such as additional flow-by area (e.g., compared to only a single passage) and/or variation in respective cross-sectional area of the multiple different passages to enable different particle sizes to travel through the multiple different passages, which in turn may result in faster cementing operations and/or improve cementing operations via low occurrence of blockages due to large particles, for example.

With the foregoing in mind, FIG. 4 is a cross-sectional side view of an embodiment of at least some features that may be provided as part of the wellhead 12. In FIG. 4, the portion of the wellhead 12 includes a wellhead housing 150 (e.g., a portion of a casing spool, such as a portion of the casing spool 26 of FIG. 1) that includes one or more housing passages 152 and a hanger 154 (e.g., a casing hanger, such as the casing hanger 36 of FIG. 1) that includes one or more hanger passages 156. The hanger 154 suspends a casing 158 that extends into a wellbore. For example, the casing 158 may pass through an additional casing and/or a conductor to extend into the wellbore.

The one or more housing passages 152 may include a single housing passage or multiple housing passages distributed (e.g., spaced apart) about the circumferential axis 48. Similarly, the one or more hanger passages 156 may include a single hanger passage or multiple hanger passages distributed (e.g., spaced apart) about the circumferential axis 48. A movable seal component 160 is configured to move relative to the one or more housing passages 152 to selectively seal the one or more housing passages 152 and relative to the one or more hanger passages 156 to selectively seal the one or more hanger passages 156.

In FIG. 4, the movable component 160 is a seal assembly 164 (e.g., annular seal assembly) positioned between the wellhead housing 150 and the hanger 154. As shown, the seal assembly 164 may include a seal body 166 (e.g., annular seal body) that supports one or more seal elements 168 (e.g., annular seal elements). In operation, a running tool(s) 170 coupled to the hanger 154 and/or the seal assembly 164 may lower the hanger 154 with the casing 158, as well as the seal assembly 164, into the wellhead housing 150. The running tool(s) 170 may lower the hanger 154 until the hanger 154 reaches a landed position in which the hanger 154 is landed on the wellhead housing 150 (e.g., axially facing or radially overlapping surfaces contact one another at an interface 172 to block further movement of the hanger 154 relative to the wellhead housing 150 toward the wellbore).

In the landed position, the seal assembly 164 may be at a first axial location of the wellhead housing 150; however, the one or more housing passages 152 and the one or more hanger passages 156 provide a bypass pathway for fluid flow (e.g., cement returns) between a second axial location within the wellhead housing 150 (e.g., below the first axial location relative to the wellbore) to a third axial location within the wellhead housing 150 (e.g., above the first axial location relative to the wellbore). For example, each of the one or more housing passages 152 includes a first opening 174 (e.g., inlet) exposed to the annular space at the second axial location and a second opening 176 (e.g., outlet) exposed to the annular space (or, more generally, a bore 178 of the wellhead housing 150) at the third axial location. Similarly, each of the one or more hanger passages 156 includes a first opening 180 (e.g., inlet) exposed to the annular space at the second axial location and a second opening 182 (e.g., outlet) exposed to the annular space (or, more generally, the bore 178 of the wellhead housing 150) at the third axial location.

As described herein, the seal assembly 164 is configured to move relative to the one or more housing passages 152 and the one or more hanger passages 156 (e.g., along the axial axis 44) to selectively seal the one or more housing passages 152 and the one or more hanger passages 156. Thus, once the hanger 156 is in the landed position with the seal assembly 164 at the first axial location within the wellhead housing 150 (e.g., between the first opening(s) 174, 180 and the second opening(s) 176, 182 along the axial axis 44; aligned with the one or more housing passages 152 and the one or more hanger passages 156 along the axial axis 44), cementing operations may commence to cement the casing 158 within the wellbore. The seal assembly 164 is positioned to enable the fluid flow from the first opening(s) 174, 180 to the second opening(s) 176, 182 via the one or more housing passages 152 and the one or more hanger passages 156. In particular, the fluid flow of fluid may travel into the first opening(s) 174, through the one or more housing passages 152, and out the second opening(s) 176 to return to the annular space (or the bore 78). At the same time, the fluid flow of fluid may travel into the first opening(s) 180, through the one or more hanger passages 156, and out the second opening(s) 182 to return to the annular space (or the bore 78).

Once the cementing operations are complete, the seal assembly 164 is driven/moved (e.g., along the axial axis 44; relative to the one or more housing passages 152 and the one or more hanger passages 156; relative to the wellhead housing 150 and the hanger 154; via the tool(s)) to block the fluid flow. For example, the seal assembly 164 may be driven/moved from a first position 190 shown in solid lines in FIG. 4 during the cementing operations to enable the fluid flow through the one or more housing passages 152 and the one or more hanger passages 156, to a second position 192 shown in dashed lines in FIG. 4 after the cementing operations to block the fluid flow. As shown, with the seal assembly 164 in the second position 192, the one or more seal elements 168 seal against the wellhead housing 150 and the hanger 154 at the second axial location of the wellhead housing 150 to block the fluid flow.

It should be appreciated that the one or more housing passages 152 and the one or more hanger passages 156 shown in FIG. 4 are merely exemplary and may have any of a variety of configurations. Accordingly, it should also be appreciated that the movable seal component 160 may also have any of a variety of configurations to selectively seal the one or more housing passages 152 and the one or more hanger passages 156. For example, the movable seal component 160 may include multiple seal components of different types, such as the seal assembly 164 to move as shown in FIG. 4 to block the fluid flow through in combination with one or more additional seal assemblies (e.g., integrated into the hanger 154), plugs, pistons, valves, plungers, or inflatable bladders to insert into and/or to block the fluid flow. Similarly, the movable seal component 160 may include multiple seal components of different types, such as the seal assembly 164 to move as shown in FIG. 4 to block the fluid flow in combination with one or more additional seal assemblies (e.g., rotatable seal assembly, such as a rotatable ring), plugs, pistons, valves, plungers, or inflatable bladders to insert into and/or to block the fluid flow.

FIG. 5 is a cross-sectional side view of an embodiment of at least some features that may be provided as part of the wellhead 12. In FIG. 5, the portion of the wellhead 12 includes a wellhead housing 200 (e.g., a portion of a casing spool, such as a portion of the casing spool 26 of FIG. 1) that includes one or more housing passages 202 and a hanger 204 (e.g., a casing hanger, such as the casing hanger 36 of FIG. 1) that includes one or more hanger passages 206. The hanger 204 suspends a casing 208 that extends into a wellbore. For example, the casing 208 may pass through an additional casing and/or a conductor to extend into the wellbore.

As shown, the one or more housing passages 202 include one or more grooves 202 (e.g., annular groove; multiple grooves distributed about the circumferential axis 48) formed in a radially inner surface of the wellhead housing 200. A movable seal component 210 includes a seal assembly 212 (e.g., annular seal assembly) that is configured to move within the wellhead housing 200 to selectively seal the one or more grooves 202. As shown, the seal assembly 212 may include annular seal elements 214 supported in annular seal grooves formed in the hanger 204 (e.g., a body of the hanger 204; a single, solid body that includes the annular seal grooves for the annular seal elements 214 and that supports the casing 208; the seal assembly 212 is integrated into the hanger 204).

In FIG. 5, the seal assembly 212 is in a first axial position in which the seal assembly 212 is axially aligned with the one or more grooves 202 to enable fluid flow to travel axially across the seal assembly 212 from a second axial location below the seal assembly 212 (e.g., relative to a wellbore; an annular space between the hanger 204 and the wellhead housing 200) to a third axial location above the seal assembly 212 (e.g., relative to the wellbore). As shown, the one or more grooves 202 provide an enlarged inner diameter of the wellhead housing 200 (e.g., relative to portions of the wellhead housing 200 above and/or below the one or more grooves 202), such that the seal assembly 212 (e.g., the annular seal elements 214 of the seal assembly 212) do not contact and do not seal against a radially inner surface of the wellhead housing 200 when the seal assembly 212 is axially aligned with the one or more grooves 202.

Various features of the wellhead housing 200 and the hanger 204 may facilitate efficient running, cementing, and sealing operations with the one or more grooves 202 and the seal assembly 212. For example, a running tool(s) 220 may run the hanger 204 with the seal assembly 212 into the wellhead housing 200 until the hanger 204 reaches a landed position in which the hanger 204 is landed on the wellhead housing 200 (e.g., axially facing or radially overlapping surfaces 222, 224 contact one another at an interface to block further movement of the hanger 204 relative to the wellhead housing 200 toward the wellbore).

In response to detection of the hanger 204 being in the landed position (e.g., slack off weight), the running tool(s) 220 moves the hanger 204 axially (e.g., away from the wellbore; raises the hanger 204) to align the seal assembly 212 with the one or more grooves 202 along the axial axis 44. Accordingly, the one or more grooves 202 are able to provide a bypass for fluid flow across the seal assembly 212. Accordingly, in this position or configuration, cementing operations may be carried out to cement the casing 208 supported by the hanger 204 in the wellbore.

Once the cementing operations are complete, the running tool(s) 220 may raise (or lower, depending on the configuration) the hanger 204 with the seal assembly 212 relative to the wellhead housing 200. Thus, the seal assembly 212 is axially offset (e.g., axially above, relative to the wellbore; or axially below, relative to the wellbore) from the one or more grooves 202 formed in the wellhead housing 200 and the one or more grooves 202 are not able to provide the bypass for fluid flow across the seal assembly 212. Indeed, the seal elements 214 of the seal assembly 214 contact and seal against the radially inner surface of the wellhead housing 200. Accordingly, in this position or configuration, the seal assembly 212 blocks the fluid flow through the one or more grooves 202 and seals an annular space between the hanger 204 and the wellhead housing 200.

Further, as shown in FIG. 5, the hanger 204 includes the one or more hanger passages 206. The one or more hanger passages 206 may include a single hanger passage or multiple hanger passages 206 distributed (e.g., spaced apart) about the circumferential axis 48 of the hanger 204. The movable seal component 210 includes a seal assembly 230 (e.g., annular seal assembly) that is configured to move relative to the one or more hanger passages 206 to selectively seal the one or more hanger passages 206. As shown, the seal assembly 230 may include a seal body 232 (e.g., annular seal body) that supports one or more seal elements 234 (e.g., annular seal elements) and that is configured to move relative to the hanger 204, such as to fit within a pocket portion 236 (e.g., annular pocket or recess) of the hanger 204, to selectively seal the one or more hanger passages 206.

In operation, the running tool(s) 220 coupled to the hanger 204 and/or the seal assembly 230 may lower the hanger 204 that includes the seal assembly 212 together with the seal assembly 230, into the wellhead housing 200. In certain embodiments, prior to running the hanger 204 and the seal assembly 230 into the wellhead housing 200, the seal assembly 230 may be coupled to the hanger 204. Thus, the seal assembly 230 may be coupled to the hanger 204 such that the seal assembly 230 is in a first position (e.g., unsealed position) relative to the hanger 204 as the running tool(s) 220 runs the hanger 204 and the seal assembly 230 into the wellhead housing 200. Thus, once the hanger 204 is aligned with the one or more grooves 202 as described herein, cementing operations may commence to cement the casing within the wellbore with both the one or more grooves 202 and the one or more hanger passages 204 open to provide a bypass pathway for the fluid flow axially across the hanger 204 and the seal assemblies 212, 230.

As described herein, such as with reference to FIG. 3, the seal assembly 230 is configured to move relative to the one or more hanger passages 206 (e.g., along the axial axis 44) to selectively seal the one or more hanger passages 206. Thus, after the cementing operations, the seal assembly 230 may be driven/moved (e.g., along the axial axis 44; via the running tool(s) 220; relative to the hanger 204; relative to the one or more hanger passages 206) to block the fluid flow. Accordingly, after the cementing operations, movement of the hanger 204 that includes the seal assembly 212 relative to the wellhead housing 200 and movement of the seal assembly 230 relative to the hanger 204 may result in sealing the one or more grooves 202 and the one or more hanger passages, respectively. It should be appreciated that such movement of the hanger 204 and such movement of the seal assembly 230 may be carried out simultaneously (e.g., together; at overlapping times) or sequentially. For example, the hanger 204 may be driven to move relative to the wellhead housing 200 to seal the one or more grooves 202, and at the same time or sequentially, the seal assembly 230 may be driven to move relative to the hanger 204 to seal the one or more hanger passages 206.

It should be appreciated that the one or more grooves 202 and the one or more hanger passages 206 shown in FIG. 5 are merely exemplary and may have any of a variety of configurations. Accordingly, it should also be appreciated that the movable seal component 210 may also have any of a variety of configurations to selectively seal the one or more grooves 202 and the one or more hanger passages 206. For example, the movable seal component 210 may include multiple seal components of different types, such as the seal assembly 212 in combination with multiple plungers that are driven/moved to extend into multiple hanger passages 206 to block the fluid flow.

Figure 8:
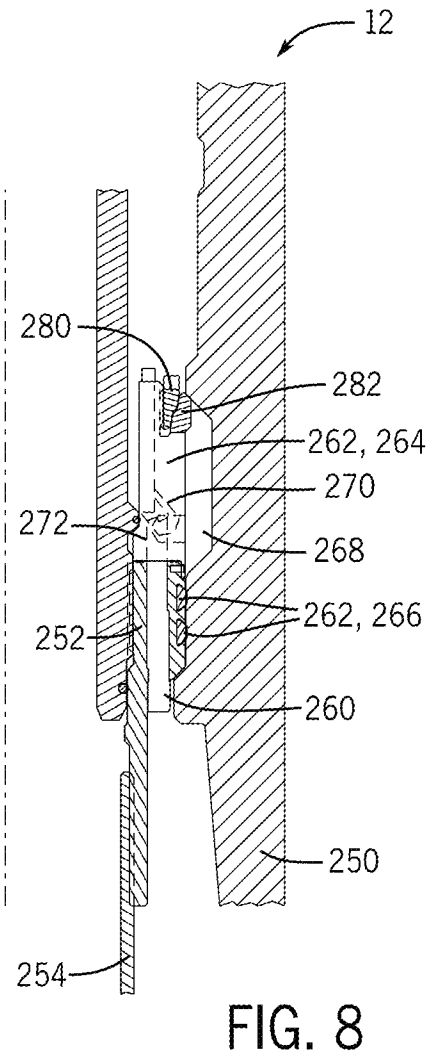
FIG. 8 is a cross-sectional side view of an embodiment of the portion of the wellhead of FIG. 6, wherein the movable seal component is positioned relative to the one or more hanger passages and the hanger is in a locked position within the wellhead housing to block the fluid flow across the hanger.
Figure 7:
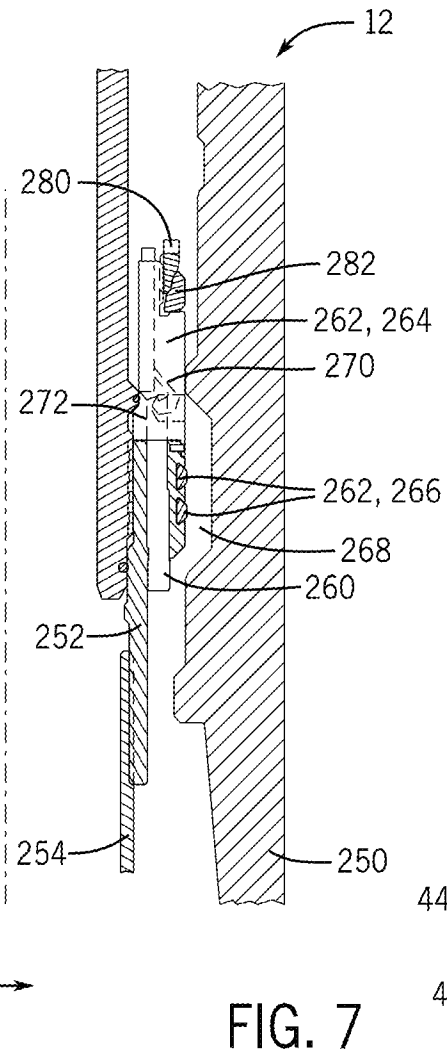
FIG. 7 is a cross-sectional side view of an embodiment of the portion of the wellhead of FIG. 6, wherein the one or more housing passages and the one or more hanger passages enable fluid flow across the hanger.
Figure 6:
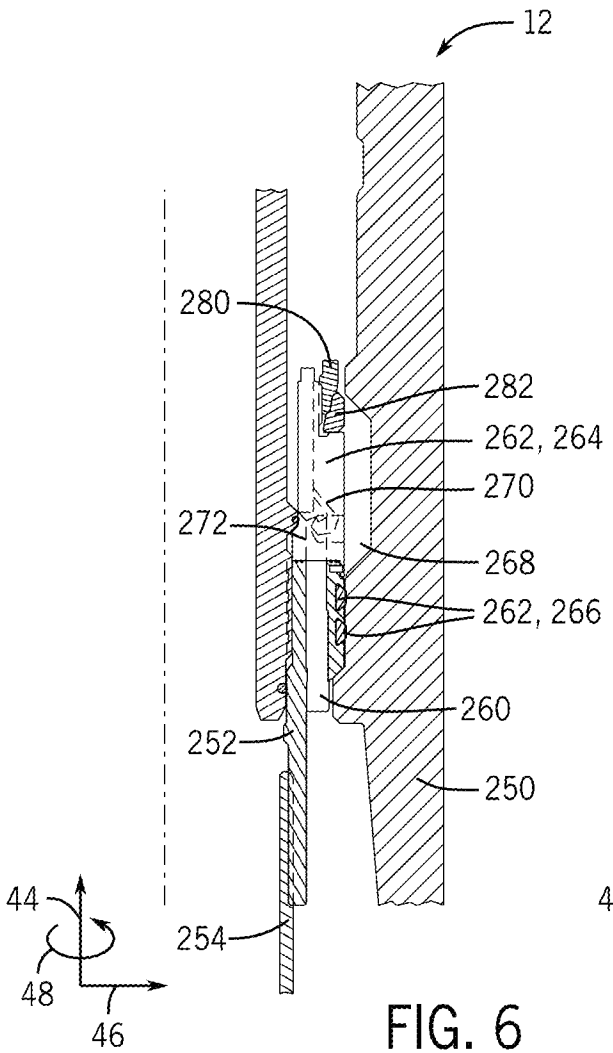
FIG. 6 is cross-sectional side view of an embodiment of a portion of a wellhead that may be utilized in the mineral extraction system of FIG. 1, wherein a wellhead housing includes one or more housing passages formed as one or more grooves, a hanger includes one or more hanger passages, and a movable seal component includes a rotatable ring.

FIGS. 6-8 are cross-sectional side views of an embodiment of at least some features that may be provided as part of the wellhead 12. As shown, the portion of the wellhead 12 includes a wellhead housing 250 (e.g., a portion of a casing spool, such as a portion of the casing spool 26 of FIG. 1) and a hanger 252 (e.g., a casing hanger, such as the casing hanger 36 of FIG. 1). The hanger 252 is positioned in the wellhead housing 250 and is configured to suspend a casing 254 that extends into a wellbore. The hanger 252 includes one or more hanger passages 260 (e.g., axial passages).

A movable component 262 may include a seal assembly 264 (e.g., annular seal assembly) positioned within the wellhead housing 250, as well as annular seal elements 266. The seal assembly 262 may be considered to include a rotatable ring, and the annular seal elements 266 are supported in annular seal grooves formed in the hanger 252 (e.g., a body of the hanger 252; integrated seal assembly). In operation, a running tool(s) may lower the hanger 252 with the casing 254 and the seal assembly 262 until the hanger 252 reaches a landed position in which the hanger 252 is landed on the wellhead housing 250 (e.g., axially facing or radially overlapping surfaces contact one another to block further movement of the hanger 252 relative to the wellhead housing 250 toward the wellbore). Thus, as shown in FIG. 6, the hanger 252 may be in the landed position.

Then, in response to detection of the hanger 252 being in the landed position (e.g., slack off weight), the running tool(s) moves the hanger 252 axially (e.g., away from the wellbore; raises the hanger 252) such that the annular seal elements 266 are axially aligned with one or more grooves 268 (e.g., one or more housing passages) formed in the wellhead housing 250. The one or more grooves 268 may extend about some or all of a circumference of the wellhead housing 250, and the one or more grooves 268 provide a bypass for fluid flow across the annular seals 266 of the seal assembly 262. For example, the fluid flow may enter into the one or more grooves 268 and then flow into one or more seal passage 270 formed in the hanger 252. As shown, the one or more grooves 268 provide an enlarged inner diameter of the wellhead housing 250 (e.g., relative to portions of the wellhead housing 250 above and/or below the one or more grooves 268), such that the annular seals 266 do not contact and do not seal against a radially inner surface of the wellhead housing 250 when the annular seals 266 are axially aligned with the one or more grooves 268.

Additionally, approximately simultaneously or sequentially with such axial movement of the hanger 252, the running tool rotates the rotatable ring of the seal assembly 264 relative to the hanger 252 and the wellhead housing 250. This may cause one or more additional seal passages 272 to align (e.g., circumferentially) with the one or more hanger passages 260 in the hanger 252. It should be appreciated that the one or more additional seal passages 272 align (e.g., circumferentially) with the one or more hanger passages 260 in the hanger 252 prior to running the hanger 252, and in such cases rotation of the rotatable ring of the seal assembly 264 is not carried out initially (e.g., prior to cementing operations). Further, it should be appreciated that the one or more seal passages 270 and the one or more additional seal passages 272 may be fluidly coupled to one another within the hanger 252 or may be fluidly isolated from one another in the hanger 252. Accordingly, in this position or configuration shown in FIG. 7, the cementing operations may be carried out to cement the casing 254 supported by the hanger 252 in the wellbore.

Once the cementing operations are complete, the running tool(s) may move (e.g., axially; lower) the hanger 252 to return to the landed position. As shown, the annular seals 266 are axially offset (e.g., axially below, relative to the wellbore; misaligned) from the one or more grooves 268 formed in the wellhead housing 250 and the one or more grooves 268 are not able to provide the bypass for fluid flow across the annular seals 266. Additionally, the running tool(s) rotates the rotatable ring 264 of the seal assembly 262 relative to the hanger 252 and the wellhead housing 250 to cause the one or more additional seal passages 272 to be circumferentially offset (e.g., misaligned) from the one or more hanger passages 260 in the hanger 252. Accordingly, in this position or configuration, the rotatable ring of the seal assembly 264 blocks the fluid flow through the one or more additional seal passages 272. In this way, the seal assembly 264 seals an annular space below the hanger 252 and the seal assembly 264 to thereby protect equipment positioned axially above the seal assembly 264, for example.

Further, as shown in FIG. 8, a setting tool (e.g., part of the running tool(s) or separate from the running tool(s)) may drive a push ring 280 (e.g., annular push ring) axially (e.g., toward the wellbore) to drives a lock ring 282 radially outwardly to engage the wellhead housing 250, such as to engage the one or more grooves 268 of the wellhead housing 250. Thus, the hanger 252 may be in a locked position within the wellhead housing 250.

In this way, the running tool(s) may lower the hanger 252 with the casing 254 and the seal assembly 264 into the wellhead housing 250, and the seal assembly 264 may remain in the wellhead housing 250 during the cementing operations. Further, the hanger 252 with the casing 254 and the seal assembly 264 may move relative to the wellhead housing 250 after the cementing operations to seal the annular space between the hanger 252 and the wellhead housing 250. In this way, the hanger 252 with the annular seals 266 and the rotatable ring of the seal assembly 264 may operate as the movable component 262 that selectively seals the annular space.

It should be appreciated that the one or more grooves 268 and the one or more hanger passages 260 shown in FIGS. 6-8 are merely exemplary and may have any of a variety of configurations. Accordingly, it should also be appreciated that the movable seal component 262 may also have any of a variety of configurations to selectively seal the one or more grooves 268 and the one or more hanger passages 260. For example, the movable seal component 262 may include multiple seal components of different types, such as the rotatable ring as the seal assembly 264 in combination with one or more additional seal assemblies (e.g., separate from the hanger 252), plugs, pistons, valves, plungers, or inflatable bladders to insert into and/or to block the fluid flow through the one or more grooves 268 and/or other arrangement of one or more housing passages (e.g., the one or more housing passages 52, 152 shown in FIGS. 2 and 4, respectively). Indeed, FIGS. 4-8 are merely intended to represent certain examples of combining features to facilitate discussion.

FIGS. 9-12 are cross-sectional side views of an embodiment of at least some features that may be provided as part of the wellhead 12. In particular, FIGS. 9-12 provide examples of an external passage 300 that may be utilized to route fluid flow from an annular space below a hanger and a seal assembly within a wellhead housing 302 to above the hanger and the seal assembly within the wellhead housing 302.

Figure 9:
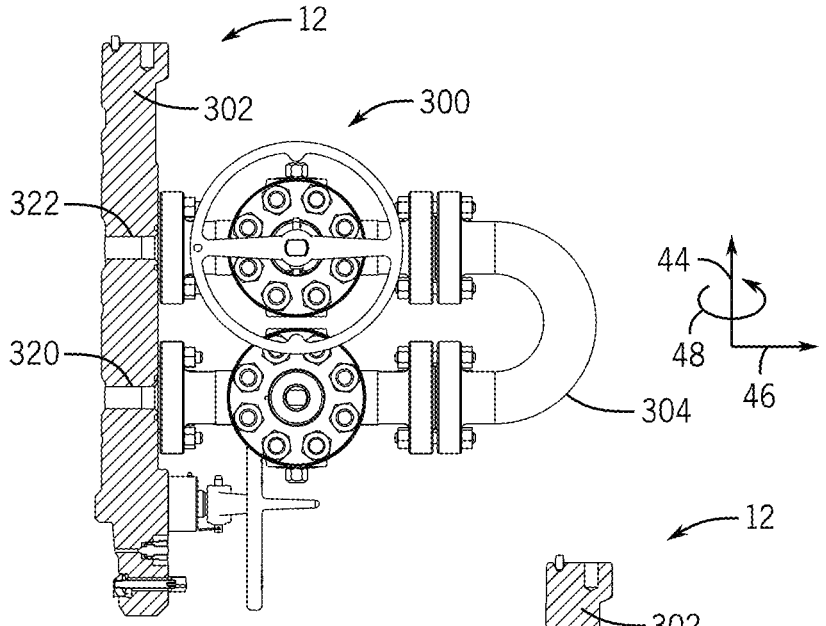
FIG. 9 is a side view of an embodiment of an external passage that may be utilized in the mineral extraction system of FIG. 1, wherein the external passage includes a loop.
Figure 10:
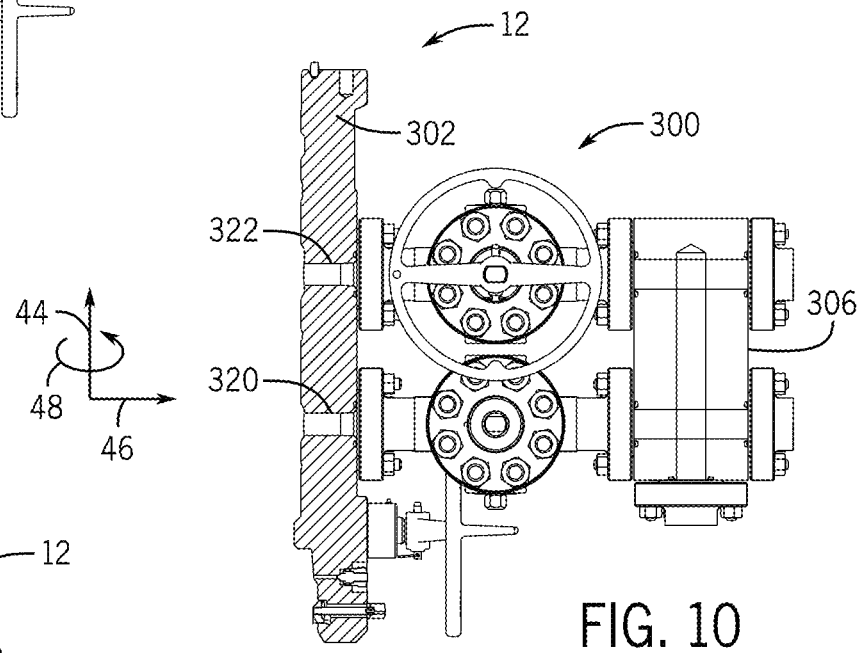
FIG. 10 is a side view of an embodiment of an external passage that may be utilized in the mineral extraction system of FIG. 1, wherein the external passage includes a valve assembly.
Figure 11:
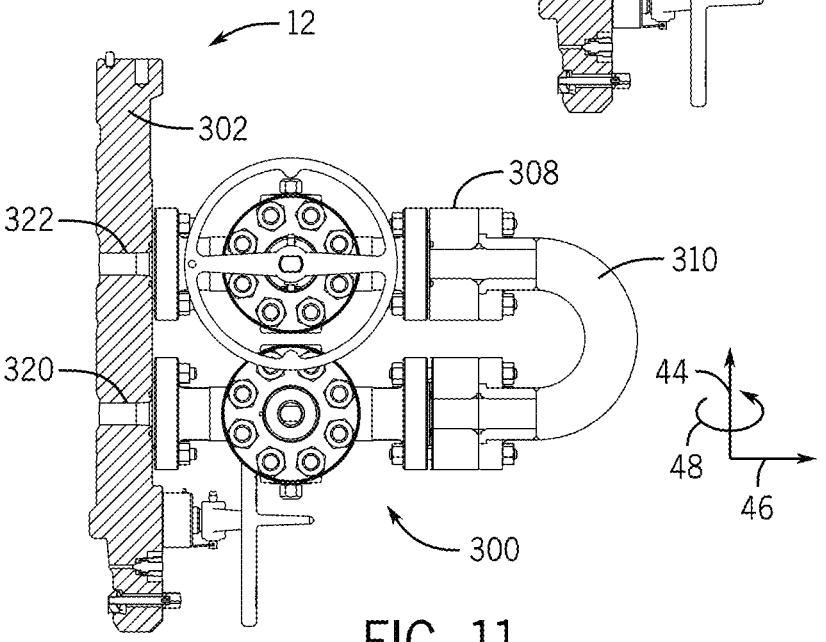
FIG. 11 is a side view of an embodiment of an external passage that may be utilized in the mineral extraction system of FIG. 1, wherein the external passage includes connectors that accommodate misalignment.
Figure 12:
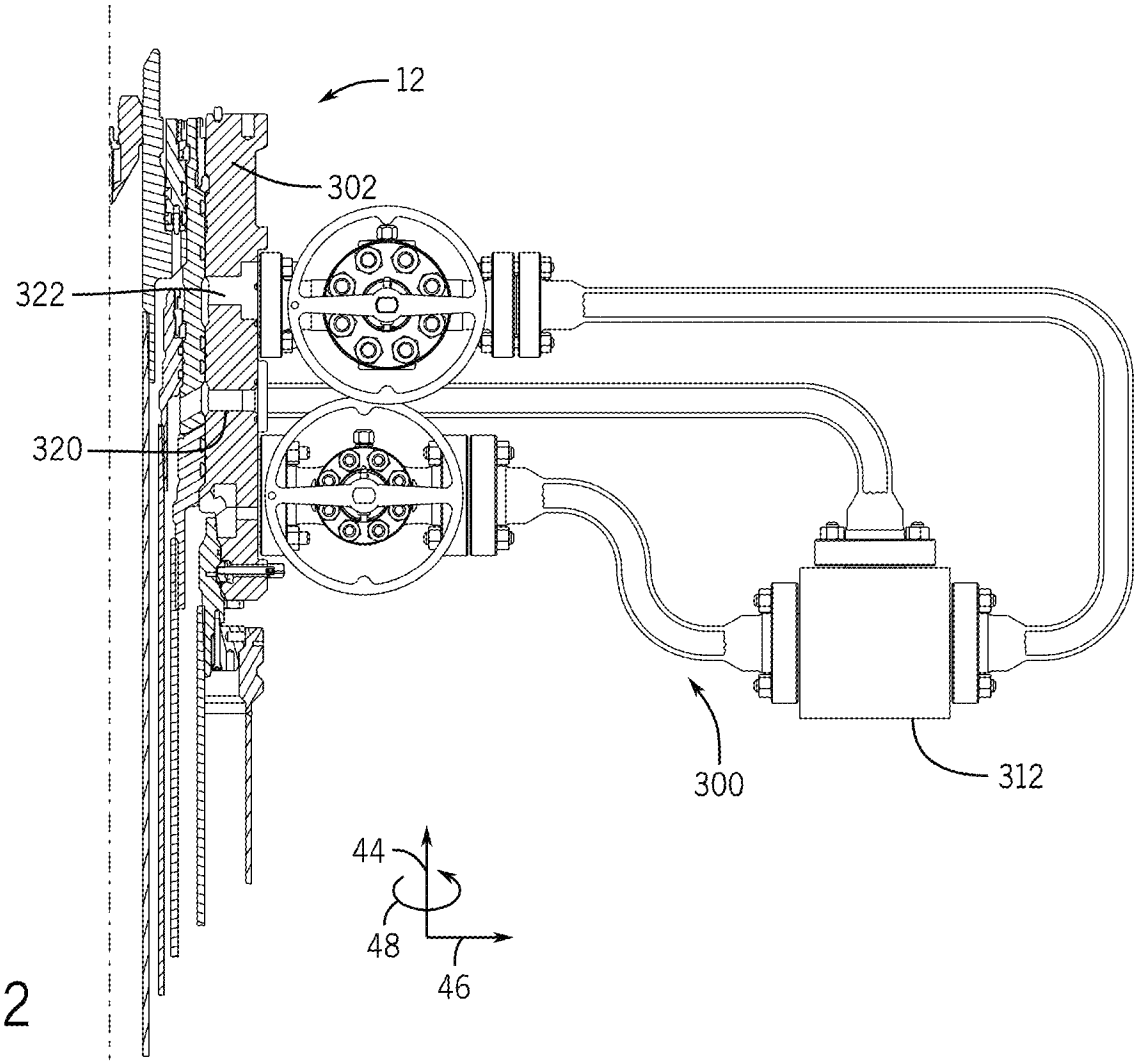
FIG. 12 is a side view of an embodiment of an external passage that may be utilized in the mineral extraction system of FIG. 1, wherein the external passage includes a manifold.

With reference to FIGS. 9-12, the external passage 300 may have various configurations. For example, the external passage 300 may include a loop 304 as shown in FIG. 9, may include a valve assembly 306 as shown in FIG. 10, may include connectors 308 that accommodate connection of a loop 310 to the wellhead housing 302, and/or may include a manifold 312 that includes one or more valves and/or one or more pumps to adjust flow of fluid through the manifold 312 (e.g., direct to particular conduit(s) from the manifold 312).

In any case, the external passage 300 may be fluidly coupled to at least one inlet 320 and at least one outlet 322. The at least one inlet 320 may extend radially through the wellhead housing 302 and may direct fluid from the wellhead housing 302 into the external passage 300. The at least one inlet 320 may be positioned axially below the hanger and the seal assembly. The at least one outlet 322 may extend radially through the wellhead housing 302 and may direct fluid into the wellhead housing 302 from the external passage 300. The at least one outlet 322 may be positioned axially above the hanger and the seal assembly. Thus, the flow of fluid may be extracted or pass out of the wellhead housing 302 via the at least one inlet 320, travel through the external passage 300, and then return to the wellhead housing 302 via the at least one outlet 322. In this way, the external passage may provide a bypass pathway for fluid flow from an annular space below the hanger and the seal assembly to above the hanger and the seal assembly.

FIGS. 9-12 illustrate various examples of one or more external passages. The one or more external passages may be selectively opened (e.g., via valves or plugs) to enable the fluid flow through the one or more external passages and covered or plugged to block the fluid flow through the one or more external passages. The one or more external passages could also be completely disconnected and removed, and then the one or more external passages could be plugged or outlets could be utilized for a different function after the cementing operations (e.g., used for annular access, connection to monitoring hardware, such as sensors, and so forth). Further, multiple external passages may be provided along the wellhead housing 302. In such cases, the multiple external passages may be distributed along the axial axis 44 to provide fluid flow at multiple stages. It should be appreciated that any features shown in FIGS. 9-12 may be combined in any suitable manner, such as to provide multiple different external passages.

Additionally, any features shown in FIGS. 9-12 may be combined in any suitable manner with any features shown in FIGS. 2-8. For example, embodiments may include one or more passages formed in or along a wellhead housing, through a hanger, external to the wellhead housing, or any combination thereof. Indeed, with reference to FIGS. 2-12, it should also be appreciated that when one or more external passages are used together with one or more housing passages and/or one or more hanger passages, such multiple passages may be arranged in any of a variety of manners. For example, the one or more external passages and the one or more housing passages may be offset relative to one another about the circumferential axis 48 to offset openings and/or grooves about the wellhead housing. As noted herein, such combinations of multiple passages may provide various advantages, such as additional flow-by area (e.g., compared to only a single passage) and/or variation in respective cross-sectional area of the multiple different passages to enable different particle sizes to travel through the multiple different passages, which in turn may result in faster cementing operations and/or improve cementing operations via low occurrence of blockages due to large particles, for example.

Figure 13:
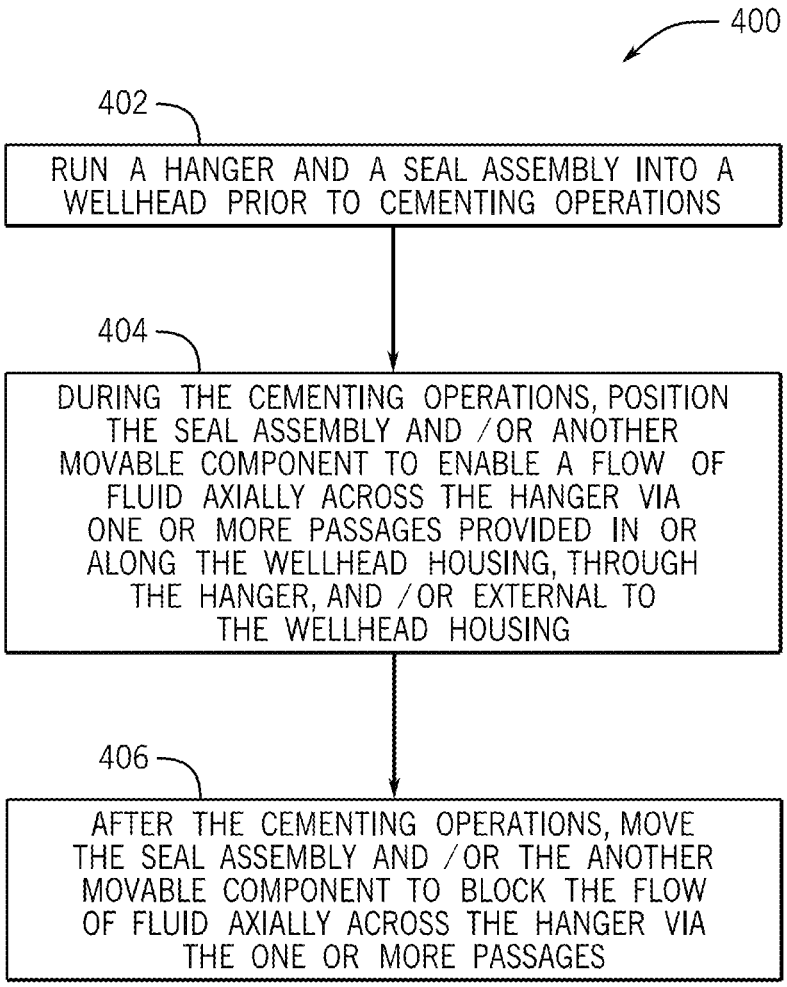
FIG. 13 is a flow diagram of an embodiment of a method of operating a wellhead to efficiently route fluid through one or more passages and to seal a hanger in a wellhead housing.

FIG. 13 is a flow diagram of an embodiment of a method 400 of operating a wellhead (e.g., the wellhead 12 of FIGS. 1-12) to efficiently route fluid through one or more passages in or along a wellhead housing, through a hanger, and/or external to the wellhead housing, as well as to seal a hanger in the wellhead housing. The method 400 disclosed herein includes various steps represented by blocks. It should be noted that at least some steps of the method 400 may be performed as an automated procedure by a system, such as an electronic control system for the wellhead. Although the flow chart illustrates the steps in a certain sequence, it should be understood that the steps may be performed in any suitable order and certain steps may be carried out simultaneously, where appropriate.

In block 402, the method 400 may begin with running a hanger and a seal assembly into a wellhead housing. Other components, such as one or more lock rings, may also be run with the hanger and the seal assembly into the wellhead housing. The seal assembly may include one or more annular seals (e.g., elastomer or metal seals; o-rings) that are configured to seal an annular space between the hanger and the wellhead housing. The seal assembly may include the one or more annular seals supported directly on the hanger (e.g., in grooves formed in a body of the hanger), or the seal assembly may include the one or more annular seals supported on an annular ring (e.g., grooves formed in the annular ring) that is coupled to and/or circumferentially surrounds a portion of the hanger.

In block 404, cementing operations may commence once the hanger and the seal assembly are positioned in the wellhead housing. During the cementing operations, the seal assembly and/or another movable seal component (e.g., a piston, a valve, a plug) may be positioned to enable a flow of fluid axially across the hanger and/or the seal assembly via one or more passages formed in or along the wellhead housing, through the hanger, and/or external to the wellhead housing.

In block 406, after the cementing operations, the seal assembly and/or the another movable seal component may be positioned to block the flow of fluid axially across the seal assembly via the one or more passages. For example, the seal assembly may be moved axially relative to the one or more passages and/or rotated relative to the one or more passages to seal the one or more passages. As another example, a movable component may be a piston, a plug, and so forth that is moved within the one or more passages to seal the one or more passages.

While the disclosure may be susceptible to various modifications and alternative forms, specific embodiments have been shown by way of example in the drawings and have been described in detail herein. It should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show a hanger and a housing of a wellhead, it should be understood that the systems and methods may be adapted to for use with any of a variety of other annular structures. Additionally, any features shown or described with reference to FIGS. 1-13 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A wellhead, comprising:

a wellhead housing having a bore about a central axis;

a hanger disposed in the bore of the wellhead housing and configured to support a casing;

a plurality of passages extending from below to above the hanger, wherein a first passage of the plurality of passages is formed through or along the wellhead housing from an annular space below the hanger to a portion of the bore above the hanger, a second passage of the plurality of passages is formed through the hanger from the annular space below the hanger to the portion of the bore above the hanger, a first axial length of the first passage axially overlaps with a second axial length of the second passage along the central axis, and the annular space is defined between the wellhead housing and the hanger; and at least one movable component disposed in the bore of the wellhead housing, wherein the at least one movable component is configured to move relative to the plurality of passages to selectively enable a flow of fluid via at least one of the plurality of passages.

2. The wellhead of claim 1, wherein the at least one movable component is configured to move axially to selectively enable the flow of fluid from the annular space to the portion of the bore.

3. The wellhead of claim 1, wherein the at least one movable component is configured to rotate to selectively enable the flow of fluid from the annular space to the portion of the bore.

4. The wellhead of claim 1, wherein the at least one movable component comprises a first movable component configured to move to selectively enable the flow of fluid via the first passage and a second movable component configured to move to selectively enable the flow of fluid via the second passage.

5. The wellhead of claim 4, wherein the first movable component comprises a first seal assembly that is configured to move axially without rotation along the central axis in the bore of the wellhead housing to selectively enable the flow of fluid via the first passage, and the second movable component comprises a second seal assembly that is configured to rotate about the central axis in the bore of the wellhead housing to selectively enable the flow of fluid via the second passage.

6. The wellhead of claim 1, wherein the at least one movable component comprises a single annular seal assembly that is configured to move axially along the central axis in the bore of the wellhead housing to selectively enable and block the flow of fluid via the first passage and the second passage.

7. The wellhead of claim 1, wherein the at least one movable component comprises an annular seal assembly extending circumferentially about the central axis, wherein the at least one movable component is configured to form an annular seal between the hanger and the wellhead housing.

8. The wellhead of claim 1, wherein the at least one moveable component comprises one or more of a plug, a piston, a plunger, a valve, an inflatable bladder, or any combination thereof.

9. The wellhead of claim 1, wherein the first passage comprises one or more grooves along an inner surface of the wellhead housing.

10. The wellhead of claim 1, wherein the hanger is configured to move axially along the central axis of the wellhead housing between first and second positions, the first position of the hanger blocks flow through the first passage, and the second position enables flow through the first passage.

11. The wellhead of claim 1, wherein the at least one movable component is configured to move axially along the central axis of the wellhead housing between first and second positions, the first position axially overlaps with the first and second axial lengths of the respective first and second passages, and the second position is axially offset away from the first and second passages.

12. The wellhead of claim 11, wherein the first passage extends between first and second housing openings in the wellhead housing, the second passage extends between first and second hanger openings in the hanger, the first position of the at least one movable component is radially between the first and second passages and axially between the first and second housing openings and the first and second hanger openings, and the second position of the at least one movable component is radially between the hanger and the wellhead housing.

13. The wellhead of claim 12, wherein the first housing opening and the first hanger opening are disposed at a common axial position relative to the central axis of the wellhead housing, and the first and second passages axially overlap from the common axial position toward the second housing opening and the second hanger opening.

14. The wellhead of claim 11, wherein the at least one movable component is disposed in a pocket portion of the hanger in the first position, and the at least one movable component is disposed radially between the hanger and the wellhead housing in the second position.

15. A wellhead, comprising:

a wellhead housing having a bore about a central axis;

a hanger disposed in the bore of the wellhead housing and configured to support a casing;

a first passage formed through or along the wellhead housing from an annular space below the hanger to a portion of the bore above the hanger, wherein the annular space is defined between the wellhead housing and the hanger;

a second passage formed through the hanger from the annular space below the hanger to the portion of the bore above the hanger, wherein a first axial length of the first passage axially overlaps with a second axial length of the second passage along the central axis; and at least one annular seal assembly disposed in the bore of the wellhead housing circumferentially about the central axis, wherein the at least one annular seal assembly is configured to move relative to the first passage and the second passage to selectively enable and block a flow of fluid axially across the hanger via the first passage and the second passage.

16. The wellhead of claim 15, comprising:

a third passage external to the wellhead housing; and at least one movable seal component configured to selectively enable and block the flow of fluid axially across the hanger via the third passage.

17. The wellhead of claim 15, wherein the at least one annular seal assembly comprises a single annular seal assembly that is configured to move axially along the central axis in the bore of the wellhead housing to selectively enable and block the flow of fluid axially across the hanger via the first passage and the second passage.

18. A method of operating a wellhead, the method comprising:

running a hanger and one or more seal assemblies into a bore of a wellhead housing having a central axis;

positioning the one or more seal assemblies in the bore of the wellhead housing to enable a flow of fluid axially across the hanger via one or more housing passages formed through or along the wellhead housing from an annular space below the hanger to a portion of the bore above the hanger and via one or more hanger passages formed through the hanger from the annular space below the hanger to the portion of the bore above the hanger, wherein a first axial length of the one or more housing passages axially overlaps with a second axial length of the one or more hanger passages along the central axis, and the annular space is defined between the wellhead housing and the hanger; and repositioning the one or more seal assemblies in the bore of the wellhead housing to block the flow of fluid axially across the hanger via the one or more housing passages formed through or along the wellhead housing and via the one or more hanger passages formed through the hanger.

19. The method of claim 18, wherein repositioning the one or more seal assemblies in the bore of the wellhead housing comprises moving at least one of the one or more seal assemblies axially along the central axis relative to the wellhead housing, the hanger, or both.

20. The method of claim 18, wherein repositioning the one or more seal assemblies in the bore of the wellhead housing comprises moving at least one of the one or more seal assemblies rotationally about the central axis relative to the wellhead housing, the hanger, or both.

* * * * *